US005709524A

United States Patent [19]

Tacchi et al.

[11] Patent Number: 5,709,524

[45] Date of Patent: Jan. 20, 1998

[54] DEVICE FOR PICKING UP STACKS OF PRODUCTS FROM A SUPPORT

[75] Inventors: Alver Tacchi; Antonio Gamberini, both of Bologna, Italy

[73] Assignee: G.D. S.p.A., Bologna, Italy

[21] Appl. No.: 662,189

[22] Filed: Jun. 12, 1996

[30] Foreign Application Priority Data

Jun. 22, 1995 [IT] Italy ..... B095A0314

[51] Int. Cl.[6] ..... B65G 59/02

[52] U.S. Cl. ..... 414/796.9; 414/796

[58] Field of Search ..... 414/622, 751, 414/792.9, 796, 796.9

[56] References Cited

U.S. PATENT DOCUMENTS 5,169,284 12/1992 Berger et al. ..... 414/796.9
5,417,543 5/1995 Focke et al. ..... 414/796.9

FOREIGN PATENT DOCUMENTS 0 363 722 4/1990 European Pat. Off. .
0 423 065 4/1991 European Pat. Off. .
0 565 493 10/1993 European Pat. Off. .

*Primary Examiner*—Janice L. Krizek
*Attorney, Agent, or Firm*—Guido Modiano; Albert Josif; Daniel J. O'Byrne

[57] ABSTRACT

A device for picking up stacks of products from a support, wherein a head for picking up a stack of products from a flat support is provided with presser elements adapted to act on the stack and with a flexible lamina adapted to enter between the stack and the flat support; the pick-up head supports presser cylinders to act on the flat support, and the lower end of the presser cylinders has feet that are movable between an inactive position and a position for insertion between the stack and the flat support to raise the stack at least at the region for the insertion of the lamina between the stack of products and the flat support.

18 Claims, 2 Drawing Sheets

DEVICE FOR PICKING UP STACKS OF PRODUCTS FROM A SUPPORT

BACKGROUND OF THE INVENTION

The present invention relates to a device for picking up stacks of products from a support.

In particular, the invention relates to a device for picking up individual stacks of cardboard cutouts that are generally arranged on a pallet-like support in multiple rows and in a plurality of layers that are separated by flat supports constituted, for example, by a sheet of cardboard of appropriate thickness.

In order to pick up individual stacks of cutouts, such as for example those used to package cigarette packs of the flip-top type, a device is known which comprises a partially flexible thin lamina to be inserted between a stack to be picked up and an underlying flat support.

The lamina is slidingly supported at the base of a pick-up head, which can move along perpendicular axes and above which a bracket that protrudes above the lamina is mounted.

The bracket supports appropriate pressers which can be actuated, along vertical axes, by corresponding actuators and furthermore supports, above the lamina, a photocell for checking the centering of the pick-up head with respect to the stack of cutouts to be picked up.

Once said centering has occurred, the pick-up head is lowered until appropriate sensors detect contact between the base of the pick-up head and the flat support of the stack.

At this point, the pressers are actuated and move downward so as to lock the stack of cutouts in an upward region, while the lamina is made to advance in order to cause its insertion between the flat support and the stack, which is therefore clamped between said lamina and additional pressers that are mounted on said bracket.

The pick-up head is then actuated in a known manner so as to raise the stack from the pallet and transfer said stack to the inlet of a user machine.

In the above-described known pick-up device, the operation for inserting the lamina between the stack and the flat support is very difficult, with jammings of said lamina against the edges of the lowermost cutouts of the stack that cause damage to the cutouts themselves.

This difficult insertion furthermore does not ensure correct pick-up of all the cutouts of the stack.

SUMMARY OF THE INVENTION

A principal aim of the present invention is to provide a pick-up device that is free from the above-described drawback.

Another object of the present invention is to provide a pickup device that is simple in concept and has a low cost.

According to the present invention, a device for picking up stacks of products from a support is provided which comprises a head for picking up a stack of products from a flat support, said head being movable along perpendicular axes; first presser means which are mounted on a bracket that is supported by said head and are adapted to act on said stack; a flexible lamina that is mounted so that it can slide with a reciprocating motion at the base of said head and is adapted to enter between said stack and said flat support; said device being characterized in that it comprises second presser means which are supported by said head and are adapted to act on said flat support; the lower ends of said second presser means having feet that are movable between an inactive position and a position for insertion between said stack and said flat support to raise said stack at least at the region for the insertion of said lamina between the stack and said flat support.

Preferably, the second presser means comprise two cylinders with vertical axes, and each cylinder is fixed in an upward region to a cross-member that is supported by said head and has an extendable rod, the free end thereof rigidly and eccentrically supporting said foot.

BRIEF DESCRIPTION OF THE DRAWINGS

The invention is now described with reference to the accompanying drawings, which illustrate by way of example a non-limitative embodiment thereof, wherein.

DESCRIPTION OF THE PREFERRED EMBODIMENTS

Figure 1:
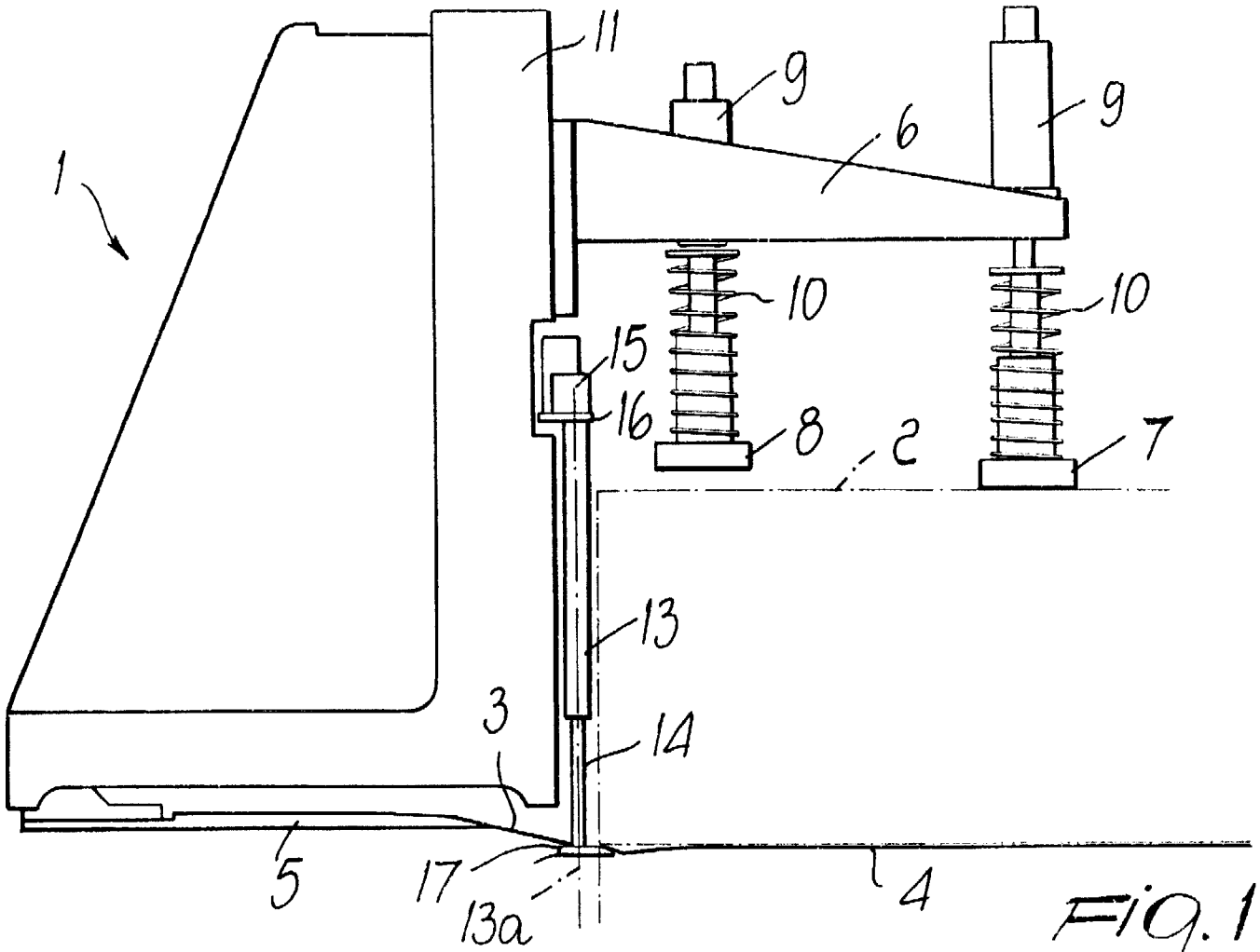
FIG. 1 is a schematic side view, with parts removed for clarity, of a preferred embodiment of the device according to the present invention.

With reference to FIG. 1, the reference numeral 1 designates a head for picking up stacks 2 of cutouts, such as for example those used to package cigarette packs of the rigid flip-top type.

According to what is shown in FIG. 1, the pick-up head 1 is movable in a known manner, along perpendicular axes, so as to be centered with respect to the stack 2 of cutouts to be picked up, and comprises a thin flexible lamina 3 adapted to enter between the stack 2 to be picked up and a flat support 4; said lamina 3 is fixed in front of a blade 5 that is mounted so that it can slide with a reciprocating motion at the base of said pick-up head 1.

A bracket 6 is mounted in an upward region on the pick-up head 1, protrudes above the lamina 3, and supports first presser means consisting of a first presser element 7 and a second presser element 8 that can be moved, along vertical axes, by respective actuator elements 9 with the interposition of respective helical springs 10.

Figure 3:
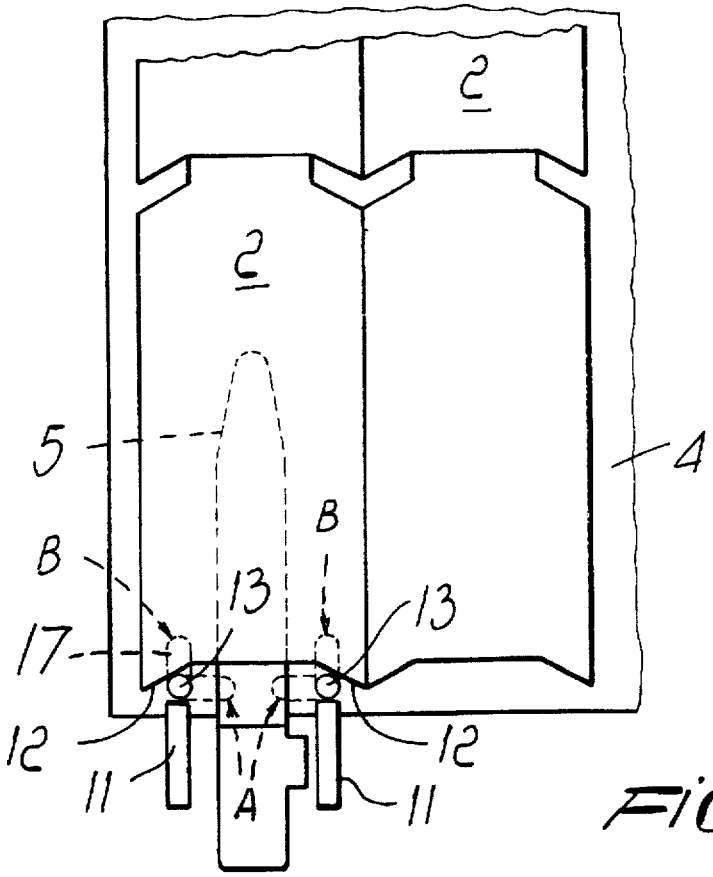
FIG. 3 is a plan view, with parts removed for clarity, of the device shown in FIG. 1.

According to what is shown in FIGS. 1 and 3, the pick-up head 1 furthermore has, in a front region, two uprights 11 arranged symmetrically on opposite sides of the lamina 3, each upright 11 contacting a vertical profiled element 12.

A presser cylinder 13, constituting second presser means, is arranged between each upright 11 and the respective element 12 and has a vertical axis 13*a*; said cylinder is adapted to act on the upper surface of the flat support 4 by means of the vertical movement of its extendable rod 14, which is actuated by an actuator 15.

Figure 2:
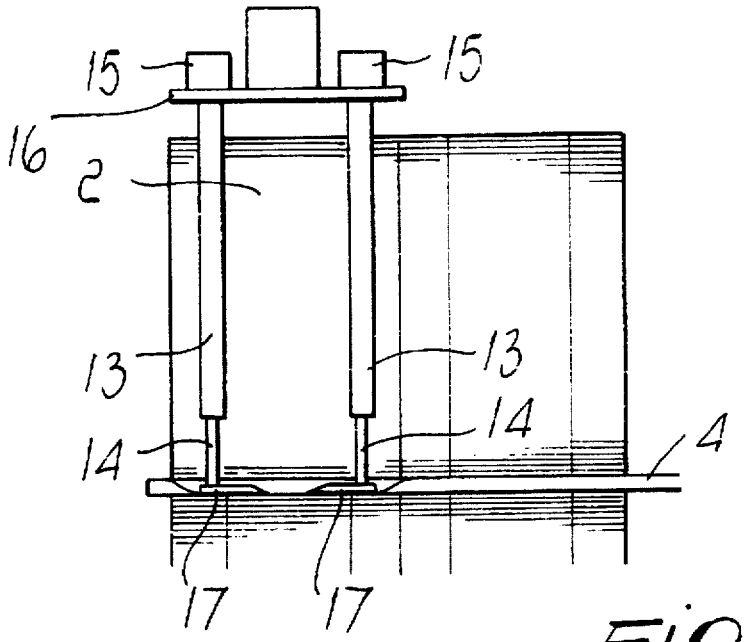
FIG. 2 is a front view, with parts removed for clarity, of a detail of the device of FIG. 1.

According to what is shown in FIGS. 1 and 2, each cylinder 13 is fixed in an upward region to a common cross-member 16 that is supported by the head 1, and the free end of its rod 14 rigidly and eccentrically supports a foot 17 arranged horizontally.

The actuators 15, in addition to moving the respective rods 14 vertically, are adapted to actuate the rotation of said rods 14 about their respective axes 13*a*, so that each foot 17 is movable, in the opposite direction with respect to the other one, between an inactive position A (dot-and-dash lines in FIG. 3), in which the feet 17 are directed towards each other, and an insertion position B (dashed lines in FIG. 3), in which each foot 17 is arranged so as to be parallel to the other one and to the lamina 3 and is inserted between the stack 2 and the flat support 4 to raise said stack 2 at the region for the insertion of the lamina 3 between the stack 2 and said flat support 4, so as to thus facilitate the insertion of said lamina 3.

During use, the pick-up head 1 is first centered, by means of a photocell (not shown), above the stack 2 of cutouts to be picked up; then the head 1 is lowered until an appropriate sensor (not shown) detects its contact with the surface that supports said stack 2, i.e., with the flat support 4.

At this point the lowering of the first presser 7 is actuated; said presser acts on the stack 2 so as to lock said stack 2 on the flat support 4, and immediately thereafter the actuators 15 actuate the lowering of the rods 14, the feet 17 thereof, arranged in the position A, are capable of applying a given pressure to the flat support 4.

As a consequence of a further actuation of the actuators 15, the feet 17 are then rotated with respect to one another in mutually opposite directions about their respective axes 13*a*, so as to move into the position B for insertion between the stack 2 and the flat support 4.

This allows the flexible lamina 3 to enter easily below the lower cutout of the stack 2, between said lower cutout and the flat support 4, as shown in FIG. 1.

After the insertion of the blade 5 and of the lamina 3 below the stack 2, the first presser 7 is raised, whereas the second presser 8 is lowered to act on the stack 2, which is thus gripped by the pick-up head 1 and is arranged and clamped between the blade 5 and the second presser 8.

Finally, the pick-up head 1 is actuated, in a known manner that is not shown, so as to raise the stack 2 and transfer said stack 2 to the inlet (not shown) of a user machine (not shown).

The present invention is susceptible of numerous modifications and variations, all of which are within the scope of the inventive concept.

All the details may furthermore be replaced with other technically equivalent elements.

The materials employed, as well as the dimensions, may be any according to the requirements.

What is claimed is:

1. A device for picking up stacks of products from a support, comprising:

a head for picking up a stack of products from a flat support, said head being movable along perpendicular axes and including a supporting bracket;

first presser means being mounted on said bracket of said head, said first presser means being operatable for fixing the stack on said flat support;

a flexible lamina mounted at a lower base of said head, said lamina being slidingly movable with a reciprocating motion at the base of said head to enter in an insertion region between said stack and said flat support;

second presser means having lower ends for acting on said flat support, said second presser means being supported by said head; and feet elements rotatably mounted on said second presser means, at said lower ends thereof, said feet elements being rotatable in mutually opposite directions between an inactive position in which they exert pressure on said flat support, and a position for insertion between said stack and said flat support for raising said stack at said insertion region to facilitate insertion of said lamina.

2. Device according to claim 1, wherein said second presser means comprises two cylinders having vertical axes, each of said cylinders being fixed in an upward region to a cross-member, said cross-member being supported by said head, said cylinders being provided with extendable rods, said feet elements being rigidly and eccentrically supported at free ends of said rods.

3. Device according to claim 2, further comprising actuator means for respectively moving said rods vertically and for turning said rods about said respective vertical axes so as to rotate said feet in mutually opposite directions between said inactive position and said insertion position.

4. Device according to claim 3, wherein said feet are eccentrically mounted on said rods for being directed towards each other in said inactive position and, upon rotation into said insertion position, to be arranged parallel to each other and to said lamina.

5. A device for picking up stacks of products from a support, comprising:

a head for picking up a stack of products from a flat support, said head being movable along perpendicular axes and including a supporting bracket located in an upward region thereof, a front region and a lower base;

first presser means for pressing on an upper region of the stack, said first presser means being mounted on said bracket of said head and being operatable for acting independently on said upper region, at least in proximity of a first end side of said stack;

a flexible lamina mounted at said lower base of said head, said lamina being slidingly movable with a reciprocating motion at the base of the head to enter in an insertion region between said stack and said flat support;

second presser means being supported at said front region of said head for vertical movement, said second presser means having lower ends for acting on said flat support; and feet elements rotatably mounted on said second presser means, at said lower ends thereof, said feet elements being rotatable in mutually opposite directions between an inactive position in which they exert pressure on said flat support, and a position for insertion between said stack and said flat support for raising said stack at said insertion region to facilitate insertion of said lamina.

6. Device according to claim 5, wherein said second presser means comprises two cylinders having vertical axes, each of said cylinders being fixed in an upward region to a cross-member and arranged between an upright and a respective profiled element of the stack, said cross-member being supported by said head, said cylinders being provided with extendable rods, said feet elements being rigidly and eccentrically supported at free ends of said rods.

7. Device according to claim 6, further comprising actuator means for respectively moving said rods vertically and for turning said rods about said respective vertical axes so as to rotate said feet in mutually opposite directions between said inactive position and said insertion position.

8. Device according to claim 7, wherein said feet are eccentrically mounted on said rods for being directed towards each other in said inactive position and, upon rotation into said insertion position, to be arranged parallel to each other and to said lamina.

9. Device according to claim 5, wherein said head comprises two uprights arranged symmetrically with respect to said lamina, and wherein each stack has vertical profiled elements, each one of said uprights contacting a respective one of said profiled elements.

10. Device according to claim 5, comprising a blade, said blade being slidingly movable at the base of said head with a reciprocating motion, said flexible lamina being fixed at a front part of said blade so as to be movable along with the blade.

11. Device according to claim 5, wherein said first presser means comprises two presser elements, said presser elements being provided for acting independently on the upper region of the stack in proximity of said first end side to lock the stack against said flat support and, respectively, in proximity of a second end side of the stack, opposite to said first end side, for gripping the stack.

12. In combination a pickup head being movable along perpendicular axes for picking up stacks of products from a flat support, the head comprising:

a supporting bracket;

first presser means being mounted on said bracket for pressing on an upper region of a stack, said first presser means being operatable for acting independently on said upper region, at least in proximity of a first end side of said stack;

a flexible lamina mounted at a lower base of the head, said lamina being slidingly movable with a reciprocating motion at the base of said head to enter in an insertion region between said stack and said flat support; and second presser means being supported a front region of said head for vertical movement, said second presser means comprising:

lower ends thereof for acting on said flat support; and feet elements rotatably mounted at said lower ends, said feet elements being rotatable in mutually opposite directions between an inactive position in which they exert pressure on said flat support, and a position for insertion between said stack and said flat support for raising said stack at said insertion region to facilitate insertion of said lamina.

13. The combination of claim 12, wherein said second presser means comprises two cylinders having vertical axes, each of said cylinders being fixed in an upward region to a cross-member and arranged between an upright and a respective profiled element of the stack, said cross-member being supported by said head, said cylinders being provided with extendable rods, said feet elements being rigidly and eccentrically supported at free ends of said rods.

14. The combination of claim 13, wherein actuator means are further provided for respectively moving said rods vertically and for turning said rods about said respective vertical axes so as to rotate said feet in mutually opposite directions between said inactive position and said insertion position.

15. The combination of claim 14, wherein said feet are eccentrically mounted on said rods for being directed towards each other in said inactive position and, upon rotation into said insertion position, to be arranged parallel to each other and to said lamina.

16. The combination of claim 12, wherein said head further comprises two uprights arranged symmetrically with respect to said lamina, and wherein each stack has vertical profiled elements, each one of said uprights contacting a respective one of said profiled elements.

17. The combination of claim 12, wherein said head comprises a blade, said blade being slidingly movable at the base of the head with a reciprocating motion, said flexible lamina being fixed at a front part of said blade so as to be movable along with the blade.

18. The combination of claim 12, wherein said first presser means comprises two presser elements, said presser elements being provided for acting independently on the upper region of the stack in proximity of said first end side to lock the stack against said flat support and, respectively, in proximity of a second end side of the stack, opposite to said first end side, for gripping the stack.

* * * * *